US006563237B1

(12) United States Patent
Bootz

(10) Patent No.: US 6,563,237 B1
(45) Date of Patent: May 13, 2003

(54) MULTI-VOLTAGE ELECTROMECHANICAL TIME SWITCH

(75) Inventor: Frederic A. Bootz, East Greenwich, RI (US)

(73) Assignee: Grasslin Controls Corporation, Mahwah, NJ (US)

( * ) Notice: Subject to any disclaimer, the term of this patent is extended or adjusted under 35 U.S.C. 154(b) by 36 days.

(21) Appl. No.: 09/614,963

(22) Filed: Jul. 12, 2000

(51) Int. Cl.[7] ..... H01H 47/00
(52) U.S. Cl. ..... 307/132 M; 200/380 A
(58) Field of Search ..... 307/132 M, 139; 200/35 R, 38 A, 38 DA; 318/770

(56) References Cited

U.S. PATENT DOCUMENTS

| | | | | | |
|---|---|---|---|---|---|
| 1,978,581 | A | * | 10/1934 | Johnson | 318/729 |
| 4,258,837 | A | * | 3/1981 | Manos et al. | 194/1 N |
| 4,449,832 | A | | 5/1984 | Kammerer | |
| 4,463,617 | A | | 8/1984 | Thoma | |
| 4,506,826 | A | | 3/1985 | Kammerer | |
| 4,507,526 | A | | 3/1985 | Thoma | |
| 4,547,689 | A | * | 10/1985 | Tsuchimoto et al. | 310/71 |
| 4,558,192 | A | | 12/1985 | Thoma | |
| 4,564,827 | A | | 1/1986 | Kammerer et al. | |
| 4,588,304 | A | | 5/1986 | Thoma | |
| 4,681,254 | A | | 7/1987 | Kammerer | |
| 4,733,026 | A | | 3/1988 | Wehrle | |
| 4,878,006 | A | * | 10/1989 | Kah, Jr. | 318/770 |
| D325,175 | S | | 4/1992 | Tinz | |
| 5,294,047 | A | | 3/1994 | Schwer et al. | |
| 6,040,646 | A | * | 3/2000 | Peters | 310/71 |
| 6,102,749 | A | * | 8/2000 | Lynn et al. | 439/810 |
| 6,136,085 | A | * | 10/2000 | Adams et al. | 106/463 |

FOREIGN PATENT DOCUMENTS

| | | | |
|---|---|---|---|
| DE | 3740748 | A1 * | 6/1989 |
| DE | 4240687 | A1 * | 5/1994 |
| EP | 0727722 | A2 * | 8/1996 |

OTHER PUBLICATIONS

Reliance Controls Corporation, Heavy Duty 24–Hour Time Switches—http://reliancecontrols.com/timeswitches/500.htm copyright 1999.*

English translation of abstract of DE 3740748A1, Pub. date Jun. 1989.*

English translation of abstract of DE 4240687A1, Pub. date May 1994.*

English translation of abstract of EP 727722A2, Pub. date Aug. 1996.*

Intermatic Incorporated—Commercial/Industrial—T2 Series Time Switches, http://www.intermatic.com/comind/t2000.htm Copyright 1999.*

TimeMaster—GM Series Time Controls Operating Instructions—Grasslin—Oct. 1997.

* cited by examiner

*Primary Examiner*—Brian Sircus
*Assistant Examiner*—Sharon A. Polk
(74) *Attorney, Agent, or Firm*—Schiff Hardin & Waite

(57) ABSTRACT

In an electromechanical time switch, an electric motor driven clock mechanism operates an electrical switch to automatically activate electrical devices at pre-selected times. The clock mechanism comprises a nominal 120 V motor. Removable jumpers are provided for permitting operation from a 120 V, 240 V, or 277 V nominal line voltage.

21 Claims, 2 Drawing Sheets

MULTI-VOLTAGE ELECTROMECHANICAL TIME SWITCH

BACKGROUND OF THE INVENTION

The present invention relates to an electromechanical time switch intended to provide time-of-day control of lighting, heating, air-conditioning, pumps, motors or general electrical circuits. They are commonly used in residential, commercial, industrial and agricultural facilities.

Such an electromechanical time switch is an electric motor driven clock mechanism which operates an electrical switch to automatically activate electrical devices or circuits at pre-selected times and intervals each day of the week (24 hour time switch) and/or on a different schedule each day of the week (7 day time switch). The electric motor driving the clock mechanism may be an alternating current synchronous motor or a direct current stepping motor pulsed by a quartz crystal oscillator. Synchronous motors are most widely used because of their low cost and greater accuracy. The switch may be Single Pole Single Throw, Single Pole Double Throw, Double Pole Single Throw, or Double Pole Double Throw.

In the prior art, a separate model of electromechanical time switch was required for each voltage (120 V, 240 V, 277 V, etc.) (V in this application refers to Volts AC). Because the electric motors operate reliably only within a narrow voltage range (100 V to 132 V is typical for a nominal 120 V motor.) This increases the inventory of manufacturers, distributors, wholesalers, and retailers as well as necessitating that the purchaser know the voltage at which the time switch will be operated.

SUMMARY OF THE INVENTION

It is an object of the invention to provide a multi-voltage time switch which offers economies in manufacturing and distribution as well as convenience to the installation service person.

According to the present invention, a compact 120 V synchronous or quartz motor driven time switch clock unit is employed which is mounted upon a printed circuit board which contains resistors and jumpers which enable the installer to select the proper voltage (120 V, 208/240 V, or 277 V) for the application. Furthermore, the compact time switch activates one or more relays with higher switch ratings to perform the load switching. Other voltages, or more than three voltage selections can be provided with additional resistors and jumpers.

DESCRIPTION OF THE PREFERRED EMBODIMENTS

Figure 1:
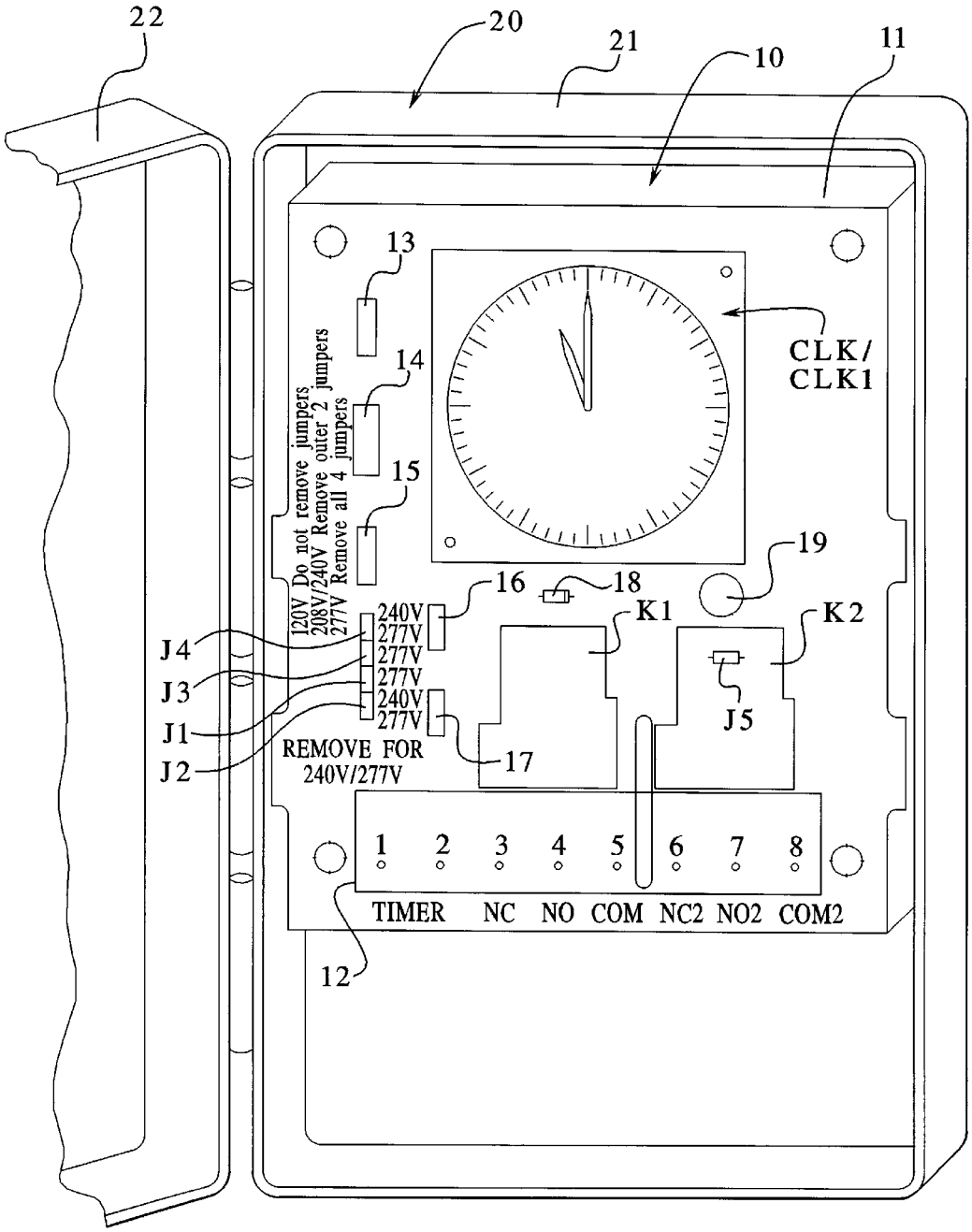
FIG. 1 is a front perspective view of the multi-voltage electromechanical time switch according to the present invention.

As shown in FIG. 1, the cabinet 20 formed of an enclosure 21 and swingable door 22 are provided for housing a printed circuit board 11 containing components described hereafter which forms a multi-voltage electromechanical time switch 10.

The 120 V nominal synchronous or quartz motor driven time switch (typically able to operate from 100 V to 132 V) comprises a clock and clock switch combination CLK/CLK1 adapted for twenty-four hour time and permits a different schedule on each of the days in a week. The user sets the time clock by accessing the cabinet 20 with the door 22 open by setting the time clock in a fashion known in the prior art for pre-selected times during each day of the week. The printed circuit board 11 contains the components shown in FIG. 2 described hereafter.

Figure 2:
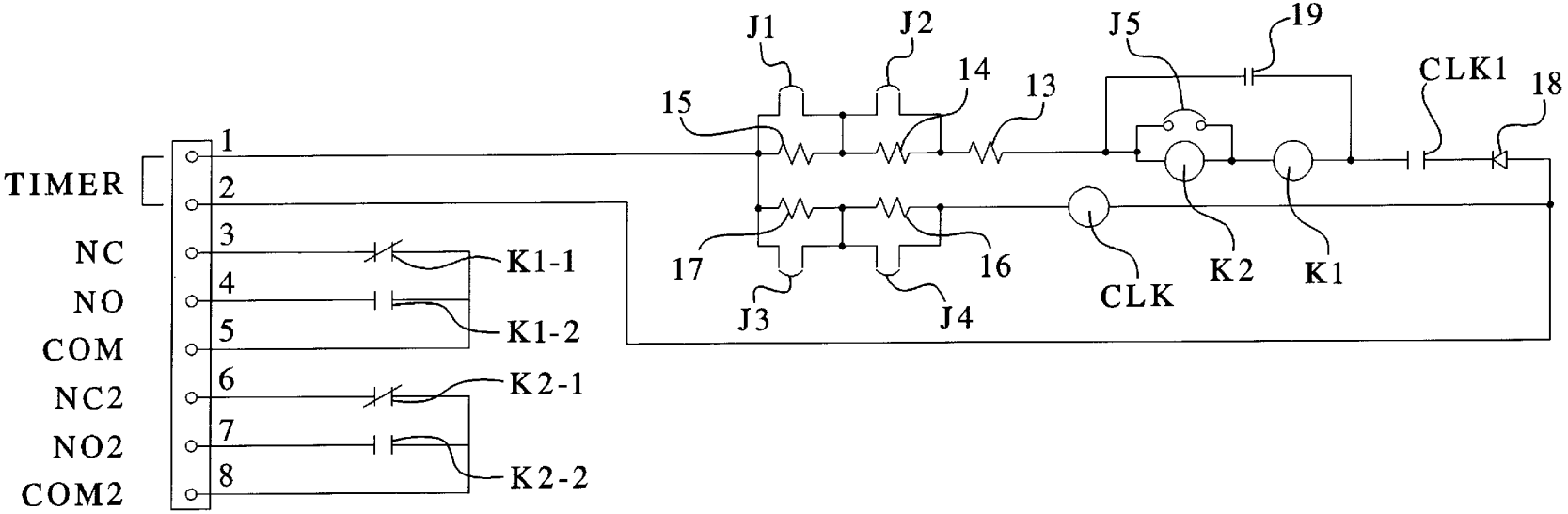
FIG. 2 is a schematic diagram illustrating the wiring for the multi-voltage electromechanical time switch of FIG. 1.

In the schematic diagram of FIG. 2, the terminal strip 12 is provided having eight pins with the functions described hereafter. The pins are connected not only to contacts K1-1, K1-2, K2-1, and K2-2, but also via terminal pins 1 and 2 to a resistor/jumper network. Specifically, a series connection of resistors 13, 14 and 15 is provided with jumpers J1 and J2 bridging resistors 15 and 14 respectively. The relay or contact coil K2 is bridged by a jumper J5, which can be a "O-ohm" shorting resistor which is in place when only one high current relay K1 is provided. The relay coil K1 is in series with coil K2. A capacitor 19 is connected in parallel across the coils K1 and K2. The clock switch CLK1 is connected in series with a diode 18. Resistor and jumper network 16, 17, J4 and J3 is connected in series with the clock motor CLK, all of which is in parallel with the previously mentioned jumper and coil network.

The clock CLK with associated switch CLK1 preferably comprises a clock permitting selection of a unique time interval for each of the seven days of the week,—and is available from Grasslin Controls Corporation of Mahwah, N.J. in the Grasslin model GMD ST-0-120—the 120 V unit.

Operation of the inventive multi-voltage electromechanical time switch will now be described.

The AC voltage source (line voltage) to operate the timer is connected to the terminals on terminal strip 12 marked "TIMER".

The electrical loads or circuits and their voltage source are connected to the terminals on terminal strip 12 marked "COM" and "NO" for single pole single throw normally open operation; to terminals "COM" and "NC" for single pole single throw normally closed operation; or to "COM", "NO", and "NC" for single pole double throw operation. The invention can be made as either single pole or double pole. The schematic shows terminals on terminal strip 12 marked "COM2", "NO2", and "NC2" for the second pole for the embodiment of the invention which is double pole double throw, in which case jumper J5 is replaced by the relay coil K2.

120 V Operation

Jumpers J1, J2, J3, and J4 remain in place for this type of operation. When 120 V is applied to the "Timer" terminals, current flows through clock CLK, the 120 V compact timer, and is shunted around resistors 13 and 16 by jumpers J3 and J4 which causes the timer to operate. The compact timer's switch CLK1 is open so that no current flows through the parallel circuit.

At the preset time for switch actuation by the compact timer, the switch CLK1 closes causing current flow through diode 18 which rectifies the AC current to half-wave DC current, which then flows through relay coil K1 for the single pole model, or through coils K1 and K2 for the double pole model and through resistor 13 which reduces the voltage to 48 V across K1 for the single pole model or to 96 V across K1 and K2 for the double pole model. Resistors 14 and 15 are shunted by jumpers J1 and J2. Capacitor 19 smooths the half wave voltage to a constant voltage across the relay coil(s). With voltage and current applied to the relay coil(s), their contacts K1-1, and K1-2 for the single pole model plus contacts K2-1 and K2-2 for the double pole model operate to activate the controlled load or circuit.

208/240 V Operations

Jumpers J2 and J4 are removed, and jumpers J1 and J3 and remain in place for this type of operation.

When 208 V or 240 V is applied to the "Timer" terminals, current flows through clock CLK, the 120 V compact timer, and through resistor 16 which reduces the voltage to 120 V across the clock CLK which causes the timer to operate and is shunted around resistor 17 by jumper J3. The compact timer's switch CLK1 is open so that no current flows through the parallel circuit.

At the preset time for switch actuation by the compact timer, CLK1 switch closes causing current flow through diode 19 which rectifies the AC current to half-wave DC current, which then flows through relay coil K1 for the single pole model, or through coils K1 and K2 for the double pole model and through resistor 13 and 14 which reduces the voltage to 48 V across K1 for the single pole model or to 96 V across K1 and K2 for the double pole model. Resistor 15 is shunted by jumper J1. Capacitor 19 smooths the half wave voltage to a constant voltage across the relay coil(s). With voltage and current applied to the relay coil(s), their contacts, for the single pole model plus contacts K2-1 and K2-2 for the double pole model operate to activate the controlled load or circuit.

277 V Operation

Jumpers J1, J2, J3, and J4 are removed for this type of operation. When 277 V is applied to the "Timer" terminals, current flows through clock CLK, the 120 V compact timer, and through resistors 17 and 16 which reduces the voltage to 120 V across the clock CLK which causes the timer to operate. The compact timer's switch CLK1 is open so that no current flows through the parallel circuit.

At the preset time for switch actuation by the compact timer, switch CLK1 closes causing current flow through diode 18 which rectifies the AC current to half-wave DC current, which then flows through relay coil K1 for the single pole, model, or through coils K1 and K2 for the double pole model and through resistors 13 and 15 which reduces the voltage to 48 V across K1 for the single pole model or to 96 V across K1 and K2 for the double pole model. Capacitor 19 smooths the half wave voltage to a constant voltage across the relay coil(s). With voltage and current applied to the relay coil(s), their contacts K1-1 and K2-2 for the single pole model plus contacts K2-1 and K2-2 for the double pole model operate to activate the controlled load or circuit.

It should be understood for purposes of the present invention that when the term "120 V" is employed, that this is intended to mean a line voltage which is nominally 120 V, but which can vary in a range from 85% to 110%. The same is true for 240 V and 277 V, which are nominal values but which can range from 85% to 110% about the nominal value.

Although various minor modifications might be suggested by those skilled in the art, it should be understood that my wish to embody within the scope of the patent warranted hereon all such modifications as reasonably and properly come with the scope of my contribution to the art.

I claim as my invention:

1. An electromechanical time switch, comprising:

an electric motor driven clock mechanism having a clock motor and which operates a control element of an electrical switch to automatically activate via the electrical switch a load device controlled by the electrical switch at pre-selected times;

said electrical switch control element being operated by a nominal 120 V;

said clock motor comprising a 120 V nominal motor; and at least one respective removable jumper associated with each of the clock motor and the control element of the electrical switch for permitting operation from a 120 V or at least a 240 V nominal line voltage.

2. The time switch according to claim 1 wherein the pre-selected times can be different for each day of a week.

3. The time switch according to claim 1 wherein the motor comprises a 120 V nominal synchronous motor.

4. The time switch of claim 1 wherein the 120 V nominal voltage can vary from 120V to 132 V.

5. The time switch according to claim 1 wherein the motor comprises a 120 V quartz motor.

6. The time switch of claim 1 wherein the 120 V nominal voltage can vary from 100 V to 132 V.

7. The time switch according to claim 1 wherein the time switch is a single pole time switch.

8. The time switch according to claim 1 wherein the time switch is a double pole time switch.

9. The time switch according to claim 1 wherein operation is also provided from 277 V nominal line voltage and the jumpers comprise first, second, third and fourth jumpers, with the first and second jumpers controlling voltage to a relay coil as said control element of the electrical switch and the third and fourth jumpers controlling voltage to the clock motor.

10. The time switch according to claim 9 wherein the first through four jumpers are arranged in a column.

11. The time switch according to claim 9 wherein a first jumper bridges first resistor, a second jumper bridges a second resistor, a third jumper bridges a third resistor, and a fourth jumper bridges a fourth resistor, the first and second jumpers being in series with said relay coil for said electrical switch, and the third and fourth jumpers being in series with said motor of said clock mechanism.

12. The time switch according to claim 11 wherein the relay coil is in series with a clock switch of the clock mechanism and a diode.

13. The time switch according to claim 12 wherein a capacitor is provided in parallel to said relay coil.

14. The time switch according to claim 1 wherein the nominal line voltage of 120 V or 240 V can vary in a range from 85% to 110%.

15. A method for operating a multi-voltage electromechanical time switch, comprising the steps of:

providing first and second jumpers associated with a control element of an electrical switch and third and fourth jumpers associated with a clock motor with an electric motor driven clock mechanism which activates the control element and which is to be connected to a line having a nominal voltage of approximately 120 V or at least 240 V; and removing various ones of said jumpers depending upon which line nominal voltage the electric motor driven clock mechanism and electrical switch control element is to be connected to.

16. The method according to claim 15 wherein the line can also be 277 V, third and fourth jumpers are provided, and for 120 V no jumpers are removed, for 240 V the second and fourth of the jumpers are removed with the first and third jumpers remaining in place, and for 277 V, the first, second, third, and fourth jumpers are removed.

17. The method according to claim 16 including the step of arranging the first through fourth jumpers in a column on a printed circuit board of the time switch.

18. The method according to claim 16 including the step of providing the first through fourth jumpers in parallel with respective first through fourth resistors, the first and second jumpers being in series with a relay contact coil, a clock switch of the clock, and a diode, and the third and fourth jumpers are in series with the clock motor of the clock mechanism.

19. The method according to claim 15 including the step of providing the clock mechanism capable of setting different time intervals for each day of the week.

20. A method for operating a multi-voltage electromechanical time switch, comprising the steps of:

providing at least a first respective removable element associated with a clock motor of an electric motor driven clock mechanism and a second respective removable element associated with a control element of an electrical switch to be connected to a line having a nominal voltage of approximately 120 V or at least approximately 240 V, the electrical switch control element being activated by the clock mechanism; and removing said first and second removable elements depending upon which line nominal voltage the clock motor and the electrical switch control element are to be connected to.

21. A method for operating a multi-voltage electromechanical time switch, comprising the steps of:

providing a clock motor of an electric motor driven clock mechanism to be connected to a line having a nominal voltage of approximately 120 V or at least approximately 240 V said clock motor having a first voltage changing element associated therewith;

providing an electrical switch having a control element also to be connected to said line, said control element being activated by said clock mechanism; said control element having a second voltage changing element associated therewith and an operator of the electromechanical time switch manipulating both said first and second voltage changing elements associated with the clock motor of the clock mechanism and said control element of said electrical switch depending upon which line nominal voltage the electric motor and electrical switch control element of the electric motor driven clock mechanism are to be connected to so that the clock mechanism and electrical switch control element can operate from that selected line nominal voltage.

* * * * *